US006598357B2

(12) United States Patent
Sanger

(10) Patent No.: US 6,598,357 B2
(45) Date of Patent: Jul. 29, 2003

(54) CONCRETE BUILDING MODULE ROOF FORM AND SUPPORT APPARATUS

(76) Inventor: Wallace D. Sanger, 11333 Acme Rd., West Palm Beach, FL (US) 33414

( * ) Notice: Subject to any disclaimer, the term of this patent is extended or adjusted under 35 U.S.C. 154(b) by 0 days.

(21) Appl. No.: 09/775,889

(22) Filed: Feb. 2, 2001

(65) Prior Publication Data

US 2002/0104281 A1 Aug. 8, 2002

(51) Int. Cl.[7] ..... E04G 11/48

(52) U.S. Cl. ..... 52/127.2; 52/749.1; 52/335; 52/338; 249/19; 249/23

(58) Field of Search ..... 52/90.1, 319, 335, 52/745.05, 745.06, 338, 340, 127.2, 127.3, 749.1; 249/18, 19, 20, 21, 23, 25

(56) References Cited

U.S. PATENT DOCUMENTS

| | | | | | |
|---|---|---|---|---|---|
| 2,556,662 | A | * | 6/1951 | Rice | 52/606 |
| 3,742,102 | A | * | 6/1973 | Stickler, Jr. | 249/185 |
| 3,807,681 | A | * | 4/1974 | Kane et al. | 249/176 |
| 3,847,521 | A | * | 11/1974 | Stickler, Jr. | 249/185 |
| 3,864,888 | A | * | 2/1975 | Tupper et al. | 52/745.05 |
| 4,003,541 | A | * | 1/1977 | Lanier | 249/18 |
| 4,078,759 | A | * | 3/1978 | Lanier | 249/18 |
| 4,450,120 | A | * | 5/1984 | Maier | 249/195 |
| 5,930,965 | A | * | 8/1999 | Carver | 264/31 |
| 6,098,359 | A | * | 8/2000 | Stodulka | 52/252 |
| 6,176,463 | B1 | * | 1/2001 | Rock | 249/18 |
| 6,279,281 | B1 | * | 8/2001 | Lee | 249/13 |

* cited by examiner

*Primary Examiner*—Carl D. Friedman
*Assistant Examiner*—Brian E. Glessner
(74) *Attorney, Agent, or Firm*—Frank L. Kubler

(57) ABSTRACT

A composite roof form includes first, second and third upright building walls laterally connected to define an interior building space, wall upper end segments of the at least a first upright building wall, a second upright building wall and a third upright building wall; the interior building space containing a building floor; a beam having an inward beam a beam upper segment and having a recessed horizontal lip portion along the bottom of the beam upper segment facing and substantially parallel with an opposing the wall, the beam upper segment defining a fourth roof form side wall; and a roof form support structure comprising at least one support leg extending from the building floor upwardly along the opposing wall to substantially the bottom of opposing second wall upper end segment and including a support panel having a panel connected end joined to the support leg and a panel engaging end with a panel upper surface and with a lip portion engaging structure resting on and supported by the lip portion, so that the panel upper surface extends along the bottom of the wall upper end segments so that the panel upper surface defines at least a portion of a roof form bottom wall.

5 Claims, 4 Drawing Sheets

CONCRETE BUILDING MODULE ROOF FORM AND SUPPORT APPARATUS

BACKGROUND OF THE INVENTION

1. Field of the Invention

The present invention relates generally to the field of concrete building forming equipment. More specifically the present invention relates to a composite roof form and to a roof form support structure for forming an integral concrete roof between the upper ends of walls of a building module or a building. The roof form includes the wall upper end segments of at least first, second and third upright building walls, these wall upper end segments having a height matching the desired roof thickness, a beam or a fourth wall and having a recessed horizontal lip portion facing the second wall, and several modular roof form support structures, each including a support leg extending from the building module floor or ground upwardly along the second wall to substantially the bottom of the second wall upper end segment and including a concrete support panel having a panel connected end joined to the support leg and a panel engaging end having an engaging flange resting on and supported by the lip portion, so that the support panel extends parallel to the first and third wall upper ends along the bottom of the wall upper end segments. The support panel upper surface defines at least a portion of the roof form bottom wall.

Each roof form support structure preferably includes two mutually parallel and laterally spaced apart support legs, each support leg being welded at its leg upper end to a hinge bar oriented perpendicular to the support legs. The support panels each preferably include a panel top sheet and a series of mutually parallel top sheet supporting panel beams secured to the panel top sheet lower face and extending from the panel connected end to the panel engaging end. Panel end beams perpendicular to the panel longitudinal beams are provided at each end of the support panel, and the panel end beam at the panel engaging end includes an outwardly directed engaging flange. Hinge plates protrude from the panel longitudinal ends at the panel connected ends and have hinge bar ports through which the hinge bar is rotatably mounted so that the support legs are jointly pivotable against the support panel for compact support structure transport and storage. The support legs preferably have broad foot plates across their lower ends to distribute the weight of concrete poured into the roof form over a wider area on the ground or module floor. The support beams are preferably welded to the lower face of the panel top sheet.

2. Description of the Prior Art

There have long been forms for pouring pre-cast concrete walls. What has been absent is a form to complete a concrete building module which permits pouring an integral concrete roof in place between the upper ends of side walls of a module.

It is thus an object of the present invention to provide roof form for completing an integral concrete building module, which permits pouring of the roof in place between the upper ends of module side walls.

It is another object of the present invention to provide such a form which can be assembled manually and without the help of lifting equipment.

It is still another object of the present invention to provide such a form which includes roof form bottom wall support structures which are modular and thus can be selected in various numbers for modules for various sizes and which are adjustable in height to accommodate modules of various heights.

It is finally an object of the present invention to provide such a form which can be assembled and disassembled by workers of ordinary skill and at minimum work time and materials expense.

SUMMARY OF THE INVENTION

The present invention accomplishes the above-stated objectives, as well as others, as may be determined by a fair reading and interpretation of the entire specification.

A composite roof form is provided, including a beam having a recessed horizontal lip portion, a portion of the beam extending above the horizontal lip portion to define a roof form side wall; at least three upright building walls laterally connected to define an interior building space, the interior building space containing a building floor, wherein one of the upright building walls is a beam opposing wall oriented to substantially face and positioned to be spaced apart from the horizontal lip portion of the beam, and where the at least three of the upright building walls each have a wall upper end segment defining a roof form side wall; and a roof form support structure including at least one support leg extending from the building floor upwardly along the opposing wall to substantially the bottom of the upper end segment of the beam opposing wall and including a support panel having a panel connected end joined to the support leg and a panel engaging end and a panel upper surface and having a lip portion engaging structure resting on and supported by the lip portion, so that the panel upper surface extends along the bottom of the wall upper end segments and the panel upper surface thereby defines at least a portion of a roof form bottom wall.

The wall upper end segments preferably each have a height substantially matching the desired roof thickness. A series of these roof form support structures are preferably provided having mutually adjacent and laterally abutting support panels defining a composite roof form bottom wall.

Each of these roof form support structures preferably includes two of the mutually parallel and laterally spaced apart support legs, each support leg having a leg upper end and being welded at its leg upper end to a perpendicularly oriented hinge bar pivotally mounted in hinge bar mounting structure connected to the support panel, the panels each including a panel top sheet and a series of mutually parallel top sheet supporting panel longitudinal beams secured to the panel top sheet lower face and extending substantially from the panel connected end substantially to the panel engaging end, and panel end beams perpendicular to the panel longitudinal beams at each end of the panel, and the panel end beam at the engaging end includes the lip engaging structure. The lip engaging structure preferably includes an outwardly directed engaging lip.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
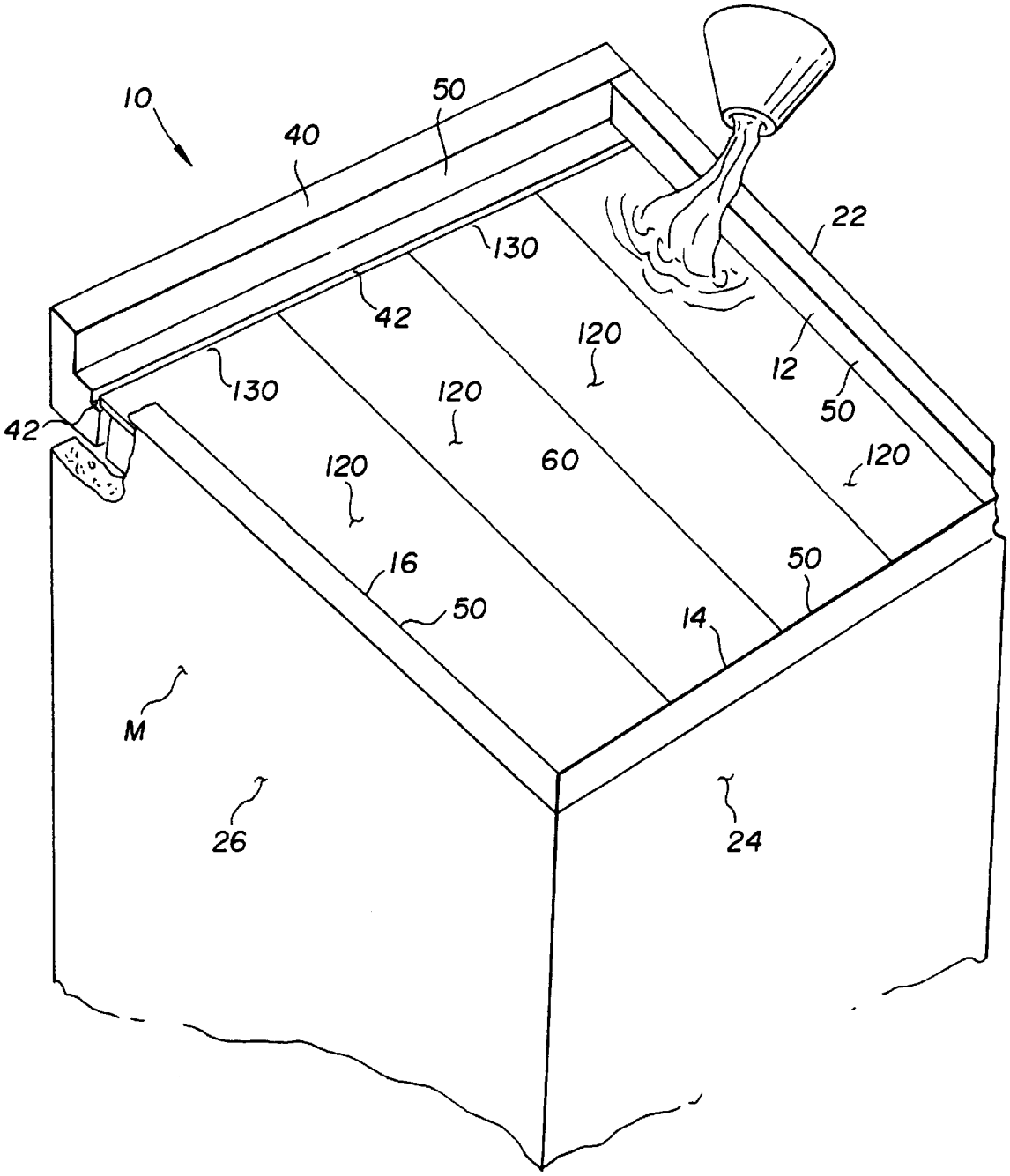
FIG. 1 is a perspective top view of a building module having a flat roof (which could alternatively be a peaked roof), showing the roof form defined by the three wall upper end segments, the beam and the panel top sheets of the roof form support structures, showing uncured concrete being poured into the roof form.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
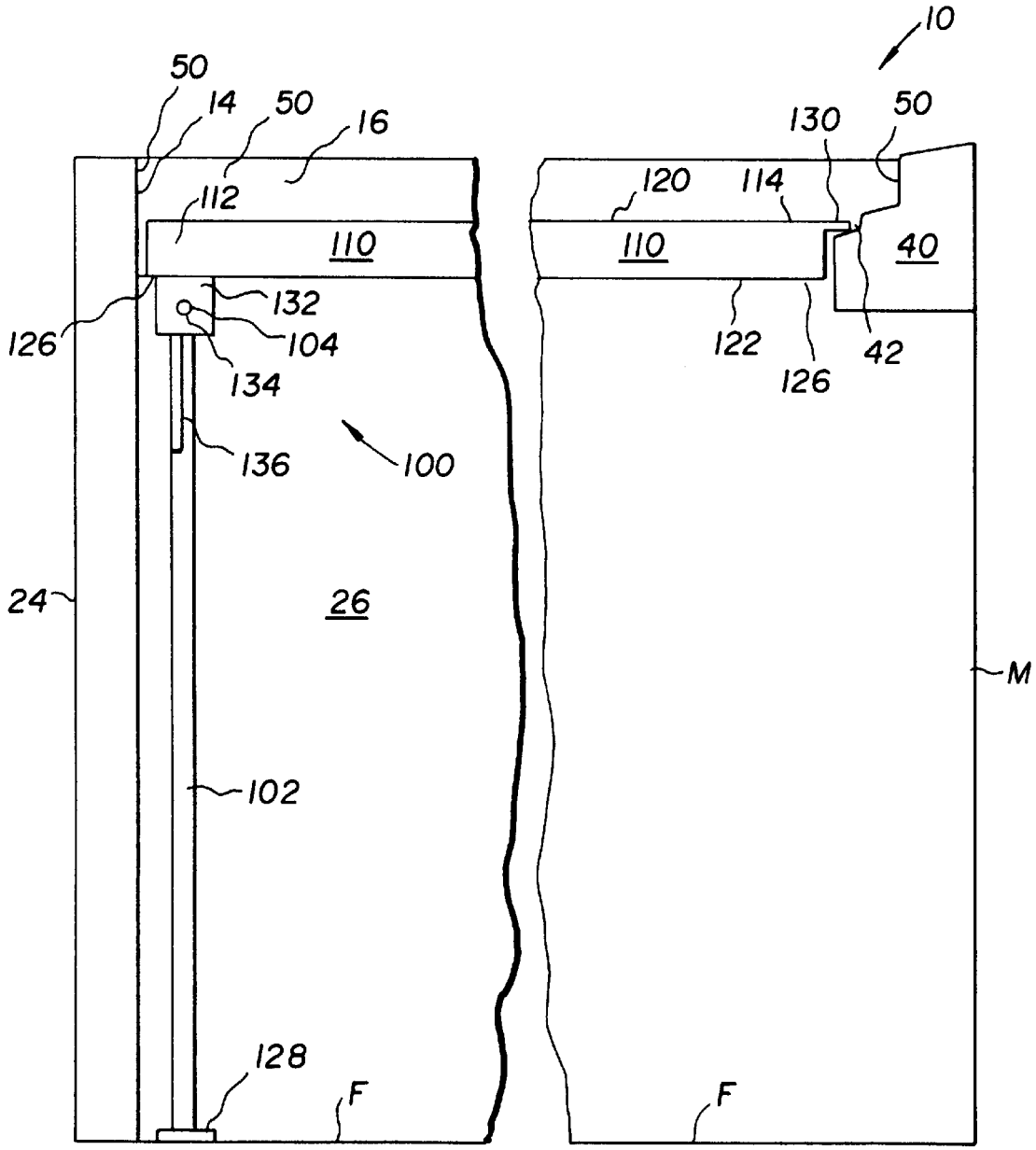
FIG. 2 is a cross-sectional side view of a building module showing the roof form and the position of the roof form support structures, and the engagement of the beam recess lip portion by the support panel engaging flange.
Figure 5:
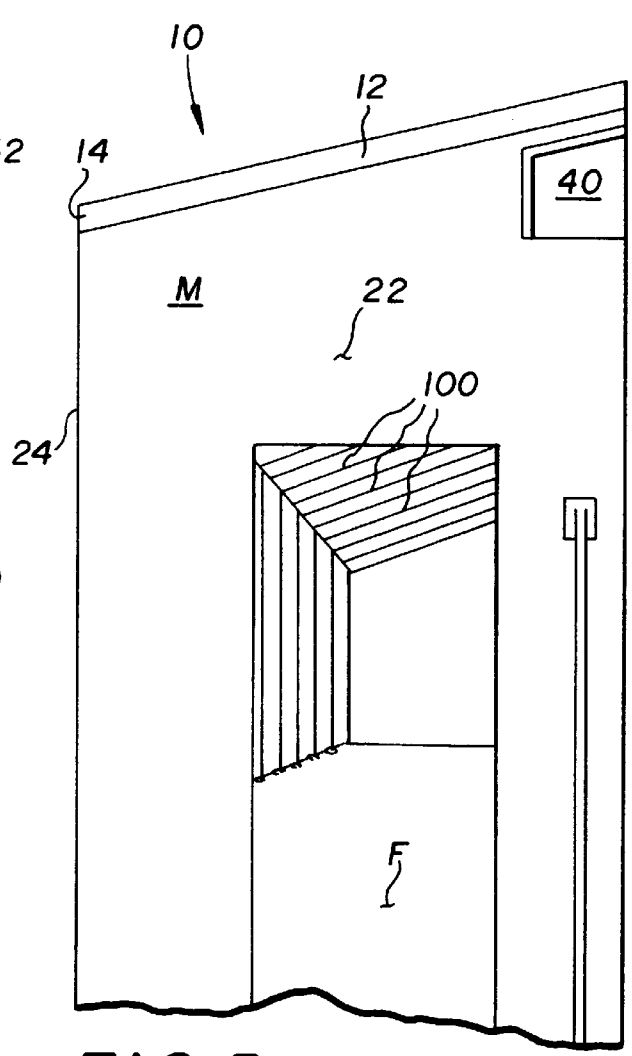
FIG. 5 is a side perspective view of a building module having the roof form in place.
Figure 4:
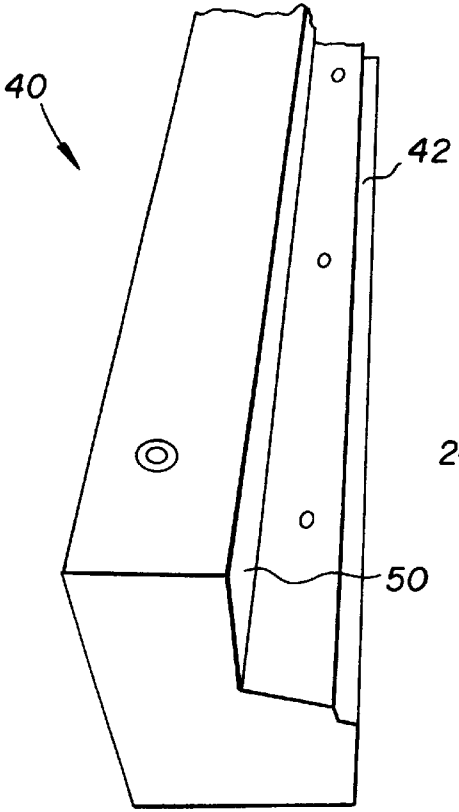
FIG. 4 is another, partial perspective view of one of the roof form beams.
Figure 3:
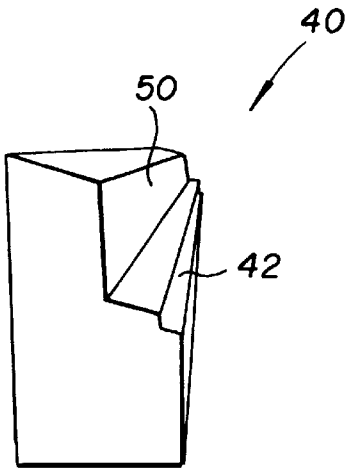
FIG. 3 is a perspective end view of one of the inventive roof form beams.
Figure 7:
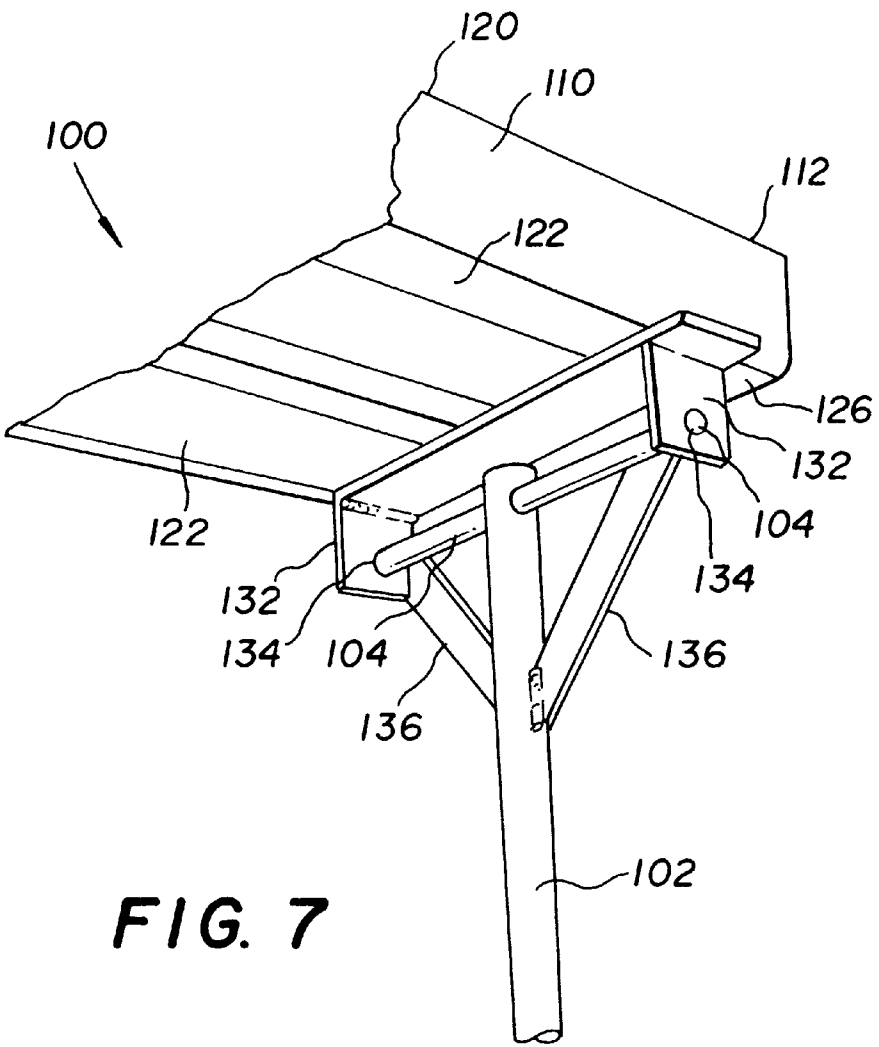
FIG. 7 is a perspective broken away partial bottom view of one of the roof form support structures, showing the preferred hinge structure interconnecting the support panel with the support leg.
Figure 6:
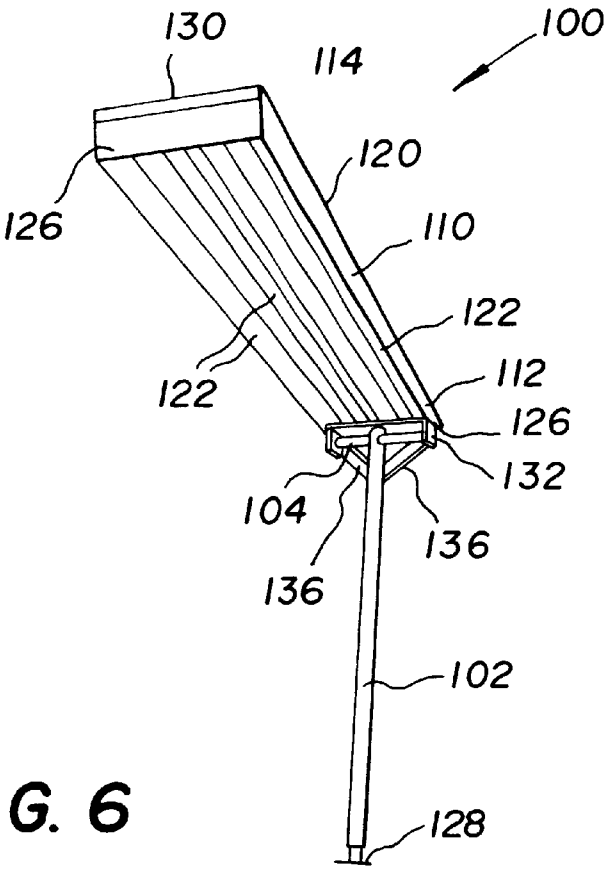
FIG. 6 is a perspective bottom view of one of the roof form support structures.

Referring to FIGS. 1–7, a composite roof form 10 and a roof form support structure 100 are provided for forming an integral concrete roof between wall upper ends of a building module M or a building. Roof form 10 includes wall upper end segments 12, 14 and 16 of at least first, second and third upright building walls 22, 24 and 26, respectively, the wall upper end segments 12, 14 and 16 having a height matching the desired roof thickness, and includes a beam 40 or a fourth wall (not shown) having a recessed horizontal lip portion 42 facing and substantially parallel with the second wall 24. The wall upper end segments 12, 14 and 16 and the beam 40 collectively define the closed perimeter wall 50 of roof form 10. Roof form 10 further includes a roof form support structure 100 having at least one support leg 102 extending from the building floor F or ground upwardly along the second wall 24 opposing and parallel to the lip portion 42 to substantially the bottom of the second wall upper end segment 14 and having a support panel 110 with a panel connected end 112 joined to the support leg 102 and a panel engaging end 114 resting on and supported by the lip portion 42, so that the panel 110 extends parallel to the first and third wall upper ends along the bottom of the wall upper end segments 12, 14 and 16 so that the panel 110 upper surface defines at least a portion of the roof form bottom wall 60.

A series of roof form support structures 100 are preferably provided having mutually adjacent and laterally abutting support panels 110 to define a composite roof form bottom wall 60. Provision of a series of modular roof form support structures 100 having relatively narrow support panels 110 is preferred because the number of roof form support structures 100 can be selected for modules M of different dimensions to define appropriate custom-sized a roof form bottom walls 60.

Each roof from support structure 100 preferably includes two mutually parallel and laterally spaced apart support legs 102, each support leg 102 being welded at its leg upper end to a perpendicularly oriented hinge bar 104. The support legs 102 are preferably each of adjustable height to be adaptable for use with building modules M of various heights. The panels 110 each preferably include a panel top sheet 120 and a series of mutually parallel top sheet supporting panel longitudinal beams 122 secured to the panel top sheet 120 lower face and extending from the panel connected end 112 to the panel engaging end 114. Panel end beams 126 perpendicular to the panel longitudinal beams 122 are provided at each end of the panel 110, and the panel end beam 126 at the engaging end 114 includes an outwardly directed engaging flange 130. A generally U-shaped hinge bracket 132 protrudes is affixed across the panel longitudinal beams 122 perpendicular to the panel end beams 126 at the panel engaging end 114 of the panels 110 and has hinge bar ports 134 through which the hinge bar 104 is rotatably mounted so that the support legs 102 are pivotable against the panel 110 for support structure 100 transport and storage. Alternatively the hinge bar ports 134 are provided in the panel longitudinal beams 122 themselves. Angled brace members 136 preferably extend from each support leg 102 to the hinge bar for greater structural strength. The panel longitudinal beams 122 may be angled segments of the top sheet 120. The support legs 102 preferably have broad foot plates 128 to distribute the weight of concrete poured into the roof form 10 over a wider area on the ground or floor F. The panel 110 and legs 102 are preferably made of aluminum for strength, low weight for efficient hand carrying and transport, and low susceptibility to corrosion. The panel longitudinal beams and panel end beams are preferably welded to the panel top sheet 120 lower face.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A composite roof form, comprising:

a beam having a recessed horizontal lip portion, a portion of said beam extending above said horizontal lip portion to define a roof form side wall;

at least three upright building walls laterally connected to define an interior building space, said interior building space containing a building floor, wherein one of said upright building walls is a beam opposing wall oriented to substantially face and positioned to be spaced apart from said horizontal lip portion of said beam, and wherein said at least three of said upright building walls each have a wall upper end segment defining a roof form side wall;

and a roof form support structure comprising at least one support leg extending from the building floor upwardly along said opposing wall to substantially the bottom of the upper end segment of said beam opposing wall and including a support panel having a panel connected end joined to said support leg and a panel engaging end and a panel upper surface and having a lip portion engaging structure resting on and supported by said lip portion, such that said panel upper surface extends along the bottom of said wall upper end segments and said panel upper surface thereby defines at least a portion of a roof form bottom wall.

2. The composite roof form of claim 1, wherein said wall upper end segments each have a height substantially matching the desired roof thickness.

3. The composite roof form of claim 1, wherein a series of said roof form support structures having mutually adjacent and laterally abutting support panels define a composite roof form bottom wall.

4. The composite roof form of claim 3, wherein each said roof form support structure comprises:

two mutually parallel and laterally spaced apart said support legs, each said support leg having a leg upper end and being welded at said leg upper end to a perpendicularly oriented hinge bar pivotally mounted in hinge bar mounting means connected to said support panel, said panels each comprising a panel top sheet and a series of mutually parallel top sheet supporting panel longitudinal beams secured to the panel top sheet lower face and extending substantially from said panel connected end substantially to said panel engaging end, and panel end beams perpendicular to said panel longitudinal beams at each end of said panel, and said panel end beam at said engaging end includes said lip engaging structure.

5. The composite roof form of claim 4, wherein said lip engaging structure comprises an outwardly directed engaging lip.

* * * * *